US005190790A

United States Patent [19]

Blankemeyer

[11] Patent Number: 5,190,790

[45] Date of Patent: Mar. 2, 1993

[54] POWDER COATING REMOVAL METHOD

[75] Inventor: Daniel E. Blankemeyer, Columbus Grove, Ohio

[73] Assignee: Metokote Corporation, Lima, Ohio

[21] Appl. No.: 694,667

[22] Filed: May 2, 1991

[51] Int. Cl.[5] ..... B05D 1/06

[52] U.S. Cl. ..... 427/466

[58] Field of Search ..... 427/14.1, 28, 198

[56] References Cited

U.S. PATENT DOCUMENTS 3,356,061 12/1967 Wiggins ..... 118/682
3,889,015 6/1975 English ..... 427/14.1
4,942,641 7/1990 Gerke, Jr. et al. ..... 15/338

*Primary Examiner*—Evan Lawrence
*Attorney, Agent, or Firm*—Killworth, Gottman, Hagan & Schaeff

[57] ABSTRACT

A method and apparatus is provided for removing electrostatically bonded powder coating material from a non-recessed region of a surface of a workpiece without removing powder coating material from a recessed region of the surface of the workpiece. The present invention employs a powder coating removal apparatus for removing the powder coating material from the non-recessed region. The powder coating removal apparatus comprises a rotatable drum including a hollow cylindrical portion having a plurality of openings therein. A plurality of elastic bands are connected to opposite end portions of the drum and serve to frictionally engage and agitate the powder coating material on the non-recessed region of the surface, thereby overcoming the electrostatic bond between the non-recessed region and the powder coating material thereon. A vacuum hose is placed adjacent to one, open end portion of the drum and serves to create a vacuum in the hollow cylindrical portion of the drum to remove the agitate powder coating material from the non-recessed region of the surface of the workpiece.

18 Claims, 3 Drawing Sheets

POWDER COATING REMOVAL METHOD

BACKGROUND OF THE INVENTION

The present invention generally relates to a method and apparatus for removing electrostatically bonded powder coating material from a non-recessed region of a surface of a workpiece without removing powder coating material from a recessed region of the surface of the workpiece.

It has heretofore not been possible to take a workpiece having powder coating material electrostatically bonded to both recessed and non-recessed regions thereof and to remove in an efficient and practical manner the powder coating material on the non-recessed region without also removing the powder coating material from the recessed region. Consequently, it has not been possible to employ in an efficient and practical manner a powder coating process to coat both a non-recessed region of a workpiece with coating material of a first color and to subsequently coat a recessed region of the workpiece with coating material of a second color.

An example of a process employed in the prior art to coat a workpiece having non-recessed and recessed regions comprises applying a first layer of powder coating material of a first color over the entire outer surface of the workpiece and thereafter curing the coating material in an oven. A section of the outer surface of the workpiece, including the recessed region, is then masked off from the remainder of the outer surface, and liquid paint of a second color is sprayed thereon. Next, the recessed region of the workpiece is masked off from the non-recess region, and liquid paint of a third color is sprayed onto the recessed region. Clear powder coating material is thereafter applied over the entire outer surface of the workpiece and cured in an oven. The clear coating serves to give the outer surface durability. This is important since liquid paint coatings lack durability and are easily chipped and scratched.

This prior art process has been found to be disadvantageous because it employs liquid paints which include volatile solvents that evaporate into the atmosphere and, thus, risk harm to the environment. The process is furthermore disadvantageous since it requires the additional step of adding a clear coating onto the outer surface of the workpiece, thereby increasing the cost of the process.

Accordingly, there is a need for a method and apparatus for efficiently removing electrostatically bonded powder coating material from a non-recessed region of a surface of a workpiece without also removing powder coating material from a recessed region of the workpiece.

SUMMARY OF THE INVENTION

This need is met by the method and apparatus of the present invention, whereby electrostatically bonded powder coating material is efficiently removed from a non-recessed region of a surface of a workpiece without also removing powder coating material from a recessed region of the workpiece. The present invention provides a powder coating removal apparatus for removing the powder coating material from the non-recessed region. The powder coating removal apparatus comprises a rotatable drum including a hollow cylindrical portion having a plurality of openings therein. A plurality of elastic bands are connected to opposite end portions of the drum and serve to frictionally engage and agitate the powder coating material on the non-recessed region of the surface of the workpiece, thereby overcoming the electrostatic bond between the non-recessed region and the powder coating material thereon. A vacuum hose is placed adjacent to one, open end portion of the drum and serves to create a vacuum in the hollow cylindrical portion of the drum. The vacuum serves to remove the agitated powder coating material from the non-recessed region of the surface of the workpiece, while not disturbing the powder coating material in the recessed region of the workpiece.

In accordance with a first aspect of the present invention, a method of applying powder coating material to a recessed region of a surface of a workpiece is provided and comprises the steps of: electrostatically bonding powder coating material onto an area of the surface of the workpiece including the recessed region and a non-recessed region; frictionally engaging the non-recessed region of the area to agitate the powder coating material thereon, thereby overcoming the electrostatic bond between the non-recessed region and the powder coating material thereon; and, removing the agitated powder coating material on the non-recessed region without removing the powder coating material in the recessed region.

In accordance with a second aspect of the present invention, a method of coating a section of a surface of a workpiece is provided and comprises the steps of: electrostatically bonding first powder coating material onto the section of the surface of the workpiece, the section including a recessed region and a non-recessed region; subjecting the section to electromagnetic radiation to at least partially cure the first powder coating material on the section; electrostatically bonding second powder coating material onto an area of the section, the area including the recessed region and a portion of the non-recessed region; frictionally engaging the portion of the non-recessed region to agitate the second powder coating material thereon, thereby overcoming the electrostatic bond between the portion of the non-recessed region and the second powder coating material thereon; applying a vacuum to the area of the section to remove the agitated powder coating material on the portion of the non-recessed region; and, subjecting the area to electromagnetic radiation to cure the first and second powder coating materials thereon.

The steps of frictionally engaging the portion of the non-recessed region to agitate the second powder coating material thereon and applying a vacuum to the area of the section preferably comprises the step of contacting the area with powder coating removal means for frictionally engaging the portion of the non-recessed region and vacuuming the second powder coating material from the portion of the non-recessed region without removing the second powder coating material located in the recessed region.

The powder coating removal means comprises: resilient contacting means for frictionally engaging the portion of the non-recessed region of the area to agitate the second powder coating material thereon, thereby overcoming the electrostatic bond between the portion of the non-recessed region and the second powder coating material thereon; and, vacuuming means associated with the resilient contacting means for removing the agitated second powder coating material from the portion of the non-recessed region without removing the second powder coating material in the recessed region.

The resilient contacting means comprises a rotatable drum having a central axis and including a first, substantially closed end portion, a second, substantially open end portion, and a hollow cylindrical portion having inner and outer surfaces and at least one opening located through the inner and outer surfaces. Rotating means are coupled to the drum for rotating the drum about its central axis. Resilient engaging means extend across the hollow cylindrical portion for frictionally engaging the portion of the non-recessed region to agitate the second powder coating material thereon so as to overcome the electrostatic bond between the portion of the non-recessed region and the second powder coating material thereon. The resilient engaging means comprises a plurality of elastic bands connected to the first and second end portions of the drum and extend across the outer surface of the hollow cylindrical portion of the drum. The vacuum means preferably is positioned adjacent to the second end portion of the drum so as to create a vacuum in the hollow cylindrical portion of the drum.

The step of electrostatically bonding first powder coating material onto the section of the surface of the workpiece preferably comprises the steps of: masking off the section from the remainder of the surface of the workpiece; and, electrostatically spraying the first powder coating material onto the section of the surface of the workpiece. The step of electrostatically bonding second powder coating material onto an area of the section of the surface of the workpiece preferably comprises the steps of: masking off the area from the remainder of the surface of the workpiece; and, electrostatically spraying the second powder coating material onto the area of the surface of the workpiece.

The step of subjecting the section to electromagnetic radiation to at least partially cure the first powder coating material on the section comprises the step of passing the section by a source of infra-red radiation to partially cure the first powder coating material on the section. Alternatively, the step of subjecting the section to electromagnetic radiation to at least partially cure the first powder coating material on the section may comprise the steps of: passing the section by a source of infra-red radiation to partially cure the first powder coating material on the section; and, passing the workpiece through a heated oven, thereby substantially completely curing the first powder coating material on the section of the surface of the workpiece.

In accordance with a third aspect of the present invention, an apparatus is provided for removing electrostatically bonded powder coating material from a non-recessed region of a surface of a workpiece without removing powder coating material from a recessed region of the surface of the workpiece. The apparatus comprises: resilient contacting means for frictionally engaging the non-recessed region of the surface to agitate the powder coating material thereon, thereby overcoming the electrostatic bond between the non-recessed region and the powder coating material thereon; and, vacuuming means associated with the resilient contacting means for removing the agitated powder coating material from the non-recessed region without removing the powder coating material in the recessed region.

The resilient contacting means may comprise a rotatable hollow drum, rotating means, and resilient engaging means as discussed above with respect to the second aspect of the present invention.

Accordingly, it is an object of the present invention to provide an method and apparatus for removing powder coating material from a non-recessed region of a surface of a workpiece without also removing powder coating material in a recessed region of the surface. It is a further object of the present invention to provide a powder coating removal apparatus for removing electrostatically bonded powder coating material from a non-recessed region of a surface of a workpiece without removing powder coating material from a recessed region of the surface. These and other objects and advantages of the invention will be apparent from the following description, the accompanying drawings and the appended claims.

DETAILED DESCRIPTION OF THE INVENTION

Figure 1C:
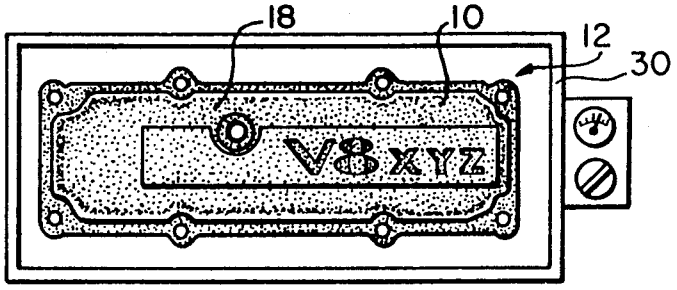
FIGS. 1*a*, 1*b*, 1*c*, 1*d*, 1*e*, 1*f*, 1*g* and 1*h* illustrate a method according to the present invention for coating a workpiece having recessed and non-recessed regions.
Figure 1D:
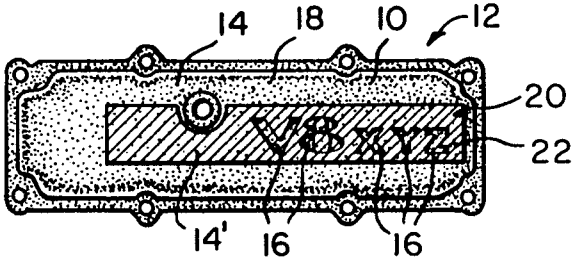
Figure 1A:
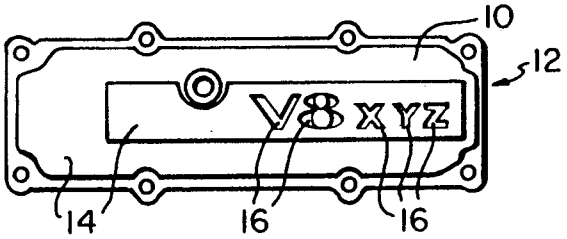

The method according to the present invention for coating the outer surface 10 of a workpiece 12 will be described with reference to FIGS. 1*a*–1*h*. Initially, the workpiece 12, which may comprise a metallic engine valve cover, as shown in FIG. 1*a*, has an uncoated outer surface 10. The outer surface 10 includes a non-recessed region 14 and a recessed region 16, which comprises embossed characters "V8 XYZ".

Figure 1B:
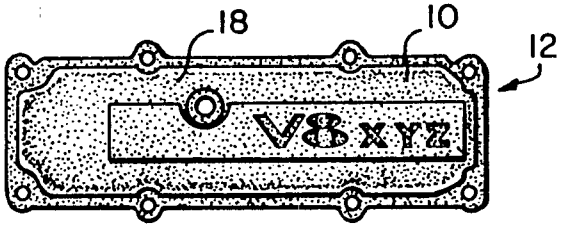

The method according to the present invention begins by taking the blank workpiece 12 and electrostatically bonding a base powder coating material 18 of a first color over substantially the entire outer surface 10 thereof, as shown in FIG. 1*b*. The base powder coating material 18 may be electrostatically bonded onto the outer surface 10 by, for example, a well-known electrostatic spray coating process. Thereafter, the base powder coating material 18 is cured in a conventional oven 30, as shown in FIG. 1*c*.

After the base powder coating material 18 has been cured onto the outer surface 10 of the workpiece 12, a section 20 of the outer surface 10, which includes the recessed region 16 and a part 14' of the non-recessed region 14, is masked off from the remainder of the outer surface 10. A first, overlapping powder coating material 22 of a second color is then electrostatically bonded to the section 20, as shown in FIG. 1*d*. The first powder coating material 22 may be bonded onto the section 20 by, for example, an electrostatic spray coating process.

Figure 1E:
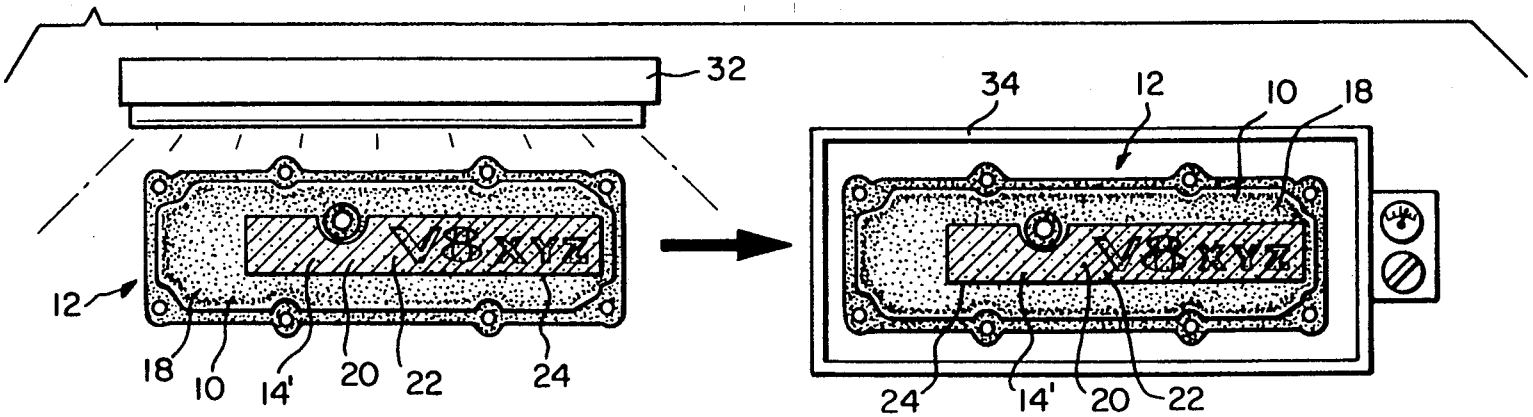

The workpiece 12 is next illuminated as it passes by an infra-red radiation source 32, as shown in FIG. 1*e*, to partially cure the first powder coating material 22 to the section 20. Thereafter, the workpiece 12 is passed through an oven 34 to substantially completely cure the first powder coating material 22 to the section 20. The first powder coating material 22 is partially cured before the workpiece 12 passes through the oven 34 to ensure that the line 24 between the first powder coating material 22 and the base coating material 18 remains well-defined and clearly distinct. If the first powder coating material 22 is not partially cured before the workpiece 12 passes through the oven 34, the air circulating through the oven 34 acts to blow a small portion of the first coating material 22 over onto the cured, base coating material 18, thereby making the line 24 between the two materials 18 and 22 appear unclear.

Figure 1G:
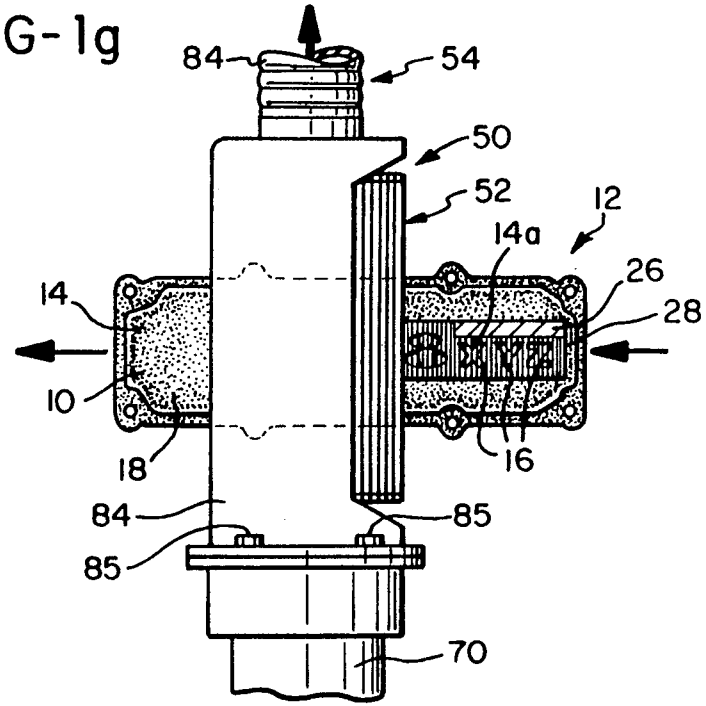
Figure 1F:
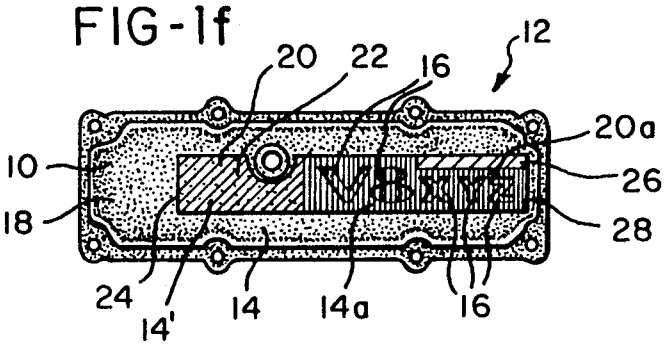

After the first powder coating material 22 has been cured, an area 26 of the section 20 is masked off from the remainder of the outer surface 10. A second overlapping powder coating material 28 of a third color is then electrostatically bonded to the area 26, as shown in FIG. 1*f*, by, for example, an electrostatic spray coating process. The area 26 comprises a segment 20*a* of the section 20 and includes the recessed region 16 and a portion 14*a* of the non-recessed region 14.

After the second powder coating material 28 has been electrostatically bonded to the area 26, the second powder coating material 28 on the portion 14*a* of the non-recessed region 14 is removed therefrom without removing the second powder coating material 28 in the recessed region 16. This step is performed by employing a powder coating removal apparatus 50, as illustrated in FIG. 1*g*.

Figure 2:
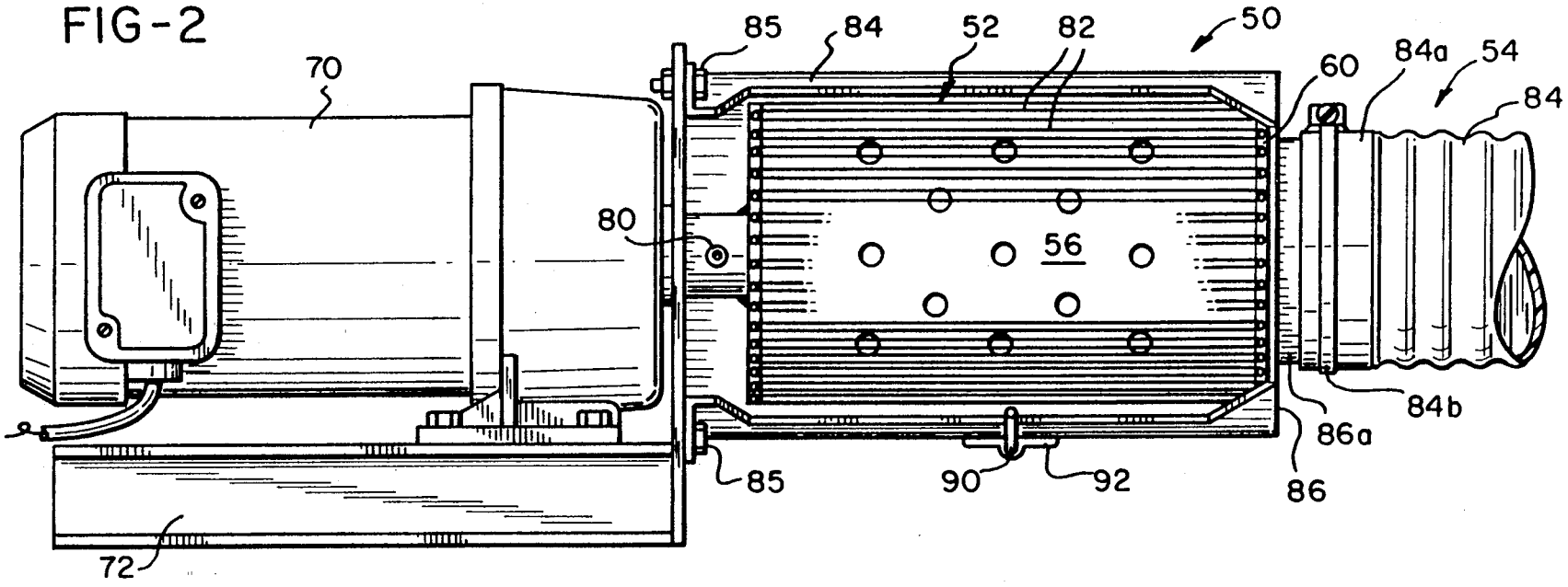
FIG. 2 is side view of a powder coating removal apparatus of the present invention with a portion of the elastic bands thereon broken-away.
Figure 3:
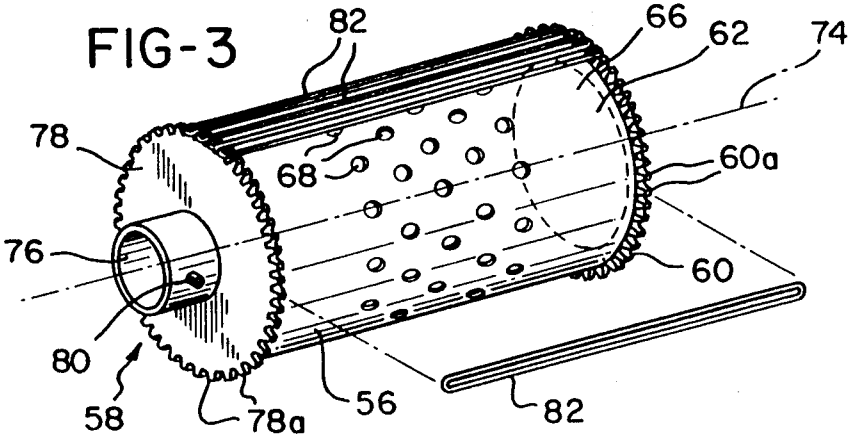
FIG. 3 is a perspective view of the drum of the powder coating removal apparatus of FIG. 2 with the first, substantially closed end portion thereof positioned on the left-hand side of the figure; and, FIG. 4 is a partially broken-out perspective view of the drum of the powder coating removal apparatus of FIG. 2 showing the second, substantially open end portion thereof.
Figure 4:
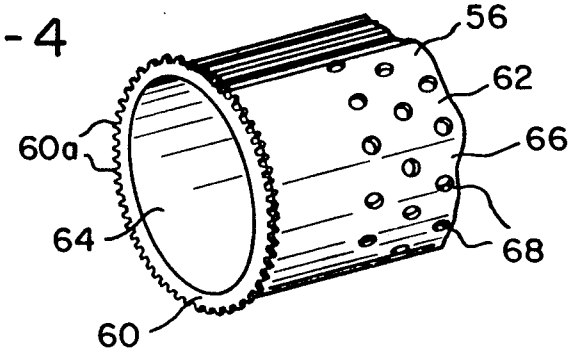

Referring to FIGS. 2–4, the powder coating removal apparatus 50 includes resilient contacting means 52 for frictionally engaging the portion 14*a* of the non-recessed region 14 to agitate the second powder coating material 28 thereon so as to overcome the electrostatic bond between the portion 14*a* and the second powder coating material 28 thereon. Vacuuming means 54 are also provided and are associated with the resilient contacting means 52 for removing the agitated second powder coating material 28 from the portion 14*a* of the non-recessed region 14 without removing the second powder coating material 28 in the recessed region 16.

The resilient contacting means 52 comprises a rotatable hollow drum 56 having a first, substantially closed end portion 58, a second, substantially open end portion 60, and a hollow cylindrical portion 62. The hollow cylindrical portion 62 includes inner and outer surfaces 64 and 66, respectively, and a plurality of openings 68 located through the inner and outer surfaces 64 and 66. A gear motor 70, also referred to herein as rotating means, is provided on a support 72 for rotating the hollow drum 56 about its central axis 74. The first end portion 58 of the drum 56 comprises a sleeve 76, which is fixedly connected to an end wall 78. The sleeve 76 is fitted over the shaft of the gear motor 70 and is lockingly connected thereto by a set screw 80 so as to permit the drum 56 to rotate with the shaft of the motor 70.

A plurality of elastic bands 82, also referred to herein as resilient engaging means, are connected to teeth 78*a* located on end wall 78 and to teeth 60*a* located on end portion 60 and extend across the outer surface 66 of the hollow cylindrical portion 62 of the drum 56. When the drum 56 is rotating and as an operator moves the outer surface 10 of the workpiece 12 against the elastic bands 82, as shown in FIG. 1*g*, the bands 82 act to frictionally engage the portion 14*a* of the non-recessed region 14. Upon engaging the portion 14*a*, the bands 82 agitate the second powder coating material 28 thereon so as to overcoming the electrostatic bond between the portion 14*a* and the second powder coating material 28 thereon. The bands 82 do not engage the recessed region 16 and, thus, do not act to overcome the electrostatic bond between the recessed region 16 and the second powder coating material 28 therein.

A shroud 84 is fixedly connected to the support 72 by bolts 85 or the like, and encases a section of the drum 56, as shown in FIGS. 1*g* and 2. An end portion 86 of the shroud 84 is positioned adjacent to the open end portion 60 of the drum 56. The end portion 86 of the shroud 84 is formed with a collar 86*a* having a central opening therein. As will be discussed below, the vacuuming means 54 is connected to the collar 86*a* and serves to create a vacuum within the drum 56 via the central opening in the collar 86*a*.

The vacuuming means 54 comprises a vacuum hose 84 which is connected at one end to a vacuum source (not shown), such as a well-known exhaust fan or dust collector. The vacuum hose 84 is also connected at a second end 84*a* to collar 86*a* by a clamp 84*b* or the like. The vacuum source and the vacuum hose 84 act to create a vacuum in the drum 56 so as to remove the second powder coating material 28 located on the portion 14*a* of the non-recessed region 14 after the second powder material 28 on the portion 14*a* has been engaged and agitated by the bands 82. The vacuum means 54 does not serve to remove the second powder coating material 28 located in the recessed region 16 since the vacuum created in the drum 56 is not sufficient to overcome the electrostatic bond between the recessed region 16 and the second powder coating material 28 therein.

Preferably, a low pressure air line 90 is connected to the shroud 84 by a bracket 92 or the like, as shown in FIG. 2. The air line 90 serves to expel low pressure air onto the elastic bands 82 as they rotate, thereby vibrating the bands 82 and causing any second powder coating material 28 collected thereon to fall off. The powder coating material 28 vibrated from the bands 82 is collected by the vacuuming means 54.

Figure 1H:
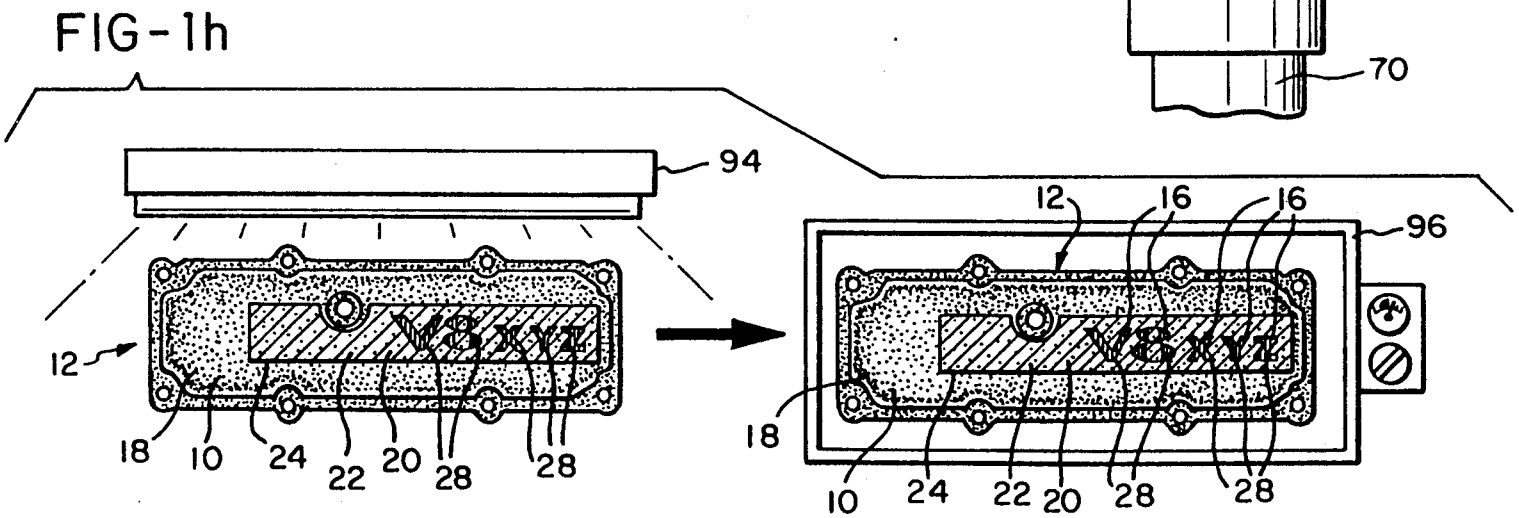

After the agitated second powder coating material 28 on the portion 14*a* of the non-recessed region 14 has been removed, the workpiece 12 is passed by an infrared radiation source 94 to partially cure the second powder material 28 located in the recessed region 16, as shown in FIG. 1*h*. Thereafter, the workpiece 12 is passed through an oven 96 to substantially completely cure the second powder coating material 28 located in the recessed region 16.

By the present invention, it is now possible to take a workpiece having powder coating material electrostatically bonded to both recessed and non-recessed regions thereof and to remove in an efficient and practical manner the powder coating material from the non-recessed region without also removing the powder coating material from the recessed region. Consequently, it is now possible to coat non-recessed and recessed regions of a workpiece with two separate coatings, each of a different color, by employing a powder coating process for applying each coating.

Having described the invention in detail and by reference to a preferred embodiment thereof, it will be apparent that modifications and variations are possible without departing from the scope of the invention defined in the appended claims. For example, it is contemplated by the present invention that the step of substantially completely curing the first powder coating material 22 to section 20 may be performed during the step of substantially completely curing the second powder coating material 28 to area 26 instead of just before the step of electrostatically bonding the second powder coating material 28 to the area 26.

What is claimed is:

1. A method of applying powder coating material to a recessed region of a surface of a workpiece, said method comprising the steps of:

electrostatically bonding powder coating material onto an area of the surface of said workpiece, said area including said recessed region and a non-recessed region;

frictionally wiping said non-recessed region of said area to agitate to powder coating material thereon, thereby overcoming the electrostatic bond between the non-recessed region and the powder coating material thereon; and removing the agitated powder coating material on said non-recessed region without removing the powder coating material in said recessed region.

2. The method as defined in claim 1, further including the step of passing said workpiece through a heated oven, thereby curing the powder coating material located in said recessed region.

3. The method as defined in claim 1, wherein the steps of frictionally wiping said non-recessed region of said area to agitate the powder coating material thereon and removing the agitated powder coating material on said non-recessed region comprises contacting said area of the surface of said workpiece with powder coating removal means for frictionally wiping said non-recessed region and vacuuming the agitated powder coating material from said non-recessed region without removing the powder coating material located in said recessed region.

4. The method as defined in claim 3, wherein said powder coating removal means comprises:

resilient contacting means for frictionally wiping said non-recessed region of said area to agitate the powder coating material thereon, thereby overcoming the electrostatic bond between said non-recessed region and the powder coating material thereon; and vacuuming means associated with said resilient contacting means for removing the agitated powder coating material from said non-recessed region without removing the powder coating material in said recessed region.

5. The method as defined in claim 4, wherein said resilient contacting means comprises:

a rotatable drum having a central axis and including a first, substantially closed end portion, a second, substantially open end portion, and a hollow cylindrical portion having inner and outer surfaces and at least one opening located through said inner and outer surfaces;

rotating means coupled to said drum for rotating said drum about its central axis; and resilient engaging means extending across said hollow cylindrical portion of said drum for engaging said non-recessed region of said area to agitate the powder coating material thereon so as to overcome the electrostatic bond between the non-recessed region and the powder coating material thereon.

6. The method as defined in claim 5, wherein said resilient engaging means comprises a plurality of elastic bands connected to said first and second end portions of said drum and extending axially along said outer surface of said hollow cylindrical portion of said drum.

7. The method as defined in claim 1, wherein the step of electrostatically bonding powder coating material onto an area of the surface of said workpiece comprises the steps of:

masking off said area from the remainder of the surface of said workpiece; and electrostatically spraying powder coating material onto said area of the surface of said workpiece.

8. A method of coating a section of a surface of a workpiece comprising the steps of:

electrostatically bonding first powder coating material onto said section of the surface of said workpiece, said section including a recessed region and a non-recessed region;

subjecting said section to electromagnetic radiation to at least partially cure said first powder coating material on said section;

electrostatically bonding second powder coating material onto an area of said section, said area including said recessed region and a portion of said non-recessed region;

frictionally engaging said portion of said non-recessed region to agitate the second powder coating material thereon, thereby overcoming the electrostatic bond between said portion of said non-recessed region and the second powder coating material thereon;

applying a vacuum to said area of said section to remove the agitated powder coating material on said portion of said non-recessed region; and subjecting said area to electromagnetic radiation to cure said first and second powder coating materials thereon.

9. The method as defined in claim 8, wherein the steps of frictionally engaging said portion of said non-recessed region to agitate the second powder coating material thereon and applying a vacuum to said area of said section comprises contacting said area with powder coating removal means for frictionally engaging said portion of said non-recessed region and vacuuming the second powder coating material from said portion of said non-recessed region without removing the second powder coating material located in said recessed region.

10. The method as defined in claim 9, wherein said powder coating removal means comprises:

resilient contacting means for frictionally engaging said portion of said non-recessed region of said area to agitate the second powder coating material thereon, thereby overcoming the electrostatic bond between said portion of said non-recessed region and the second powder coating material thereon; and vacuuming means associated with said resilient contacting means for removing the agitated second powder coating material from said portion of said non-recessed region without removing the second powder coating material in said recessed region.

11. The method as defined in claim 10, wherein said resilient contacting means comprises:

a rotatable drum having a central axis and including a first, substantially closed end portion, a second, substantially open end portion, and a hollow cylindrical portion having inner and outer surfaces and at least one opening located through said inner and outer surfaces;

rotating means coupled to said drum for rotating said drum about its central axis; and resilient engaging means extending across said hollow cylindrical portion for frictionally engaging said portion of said non-recessed region to agitating the second powder coating material thereon so as to overcome the electrostatic bond between said portion of said non-recessed region and the second powder coating material thereon.

12. The method as defined in claim 11, wherein said resilient engaging means comprises a plurality of elastic bands connected to said first and second end portions of said drum and extending across said outer surface of said hollow cylindrical portion of said drum.

13. The method as defined in claim 8, wherein the step of electrostatically bonding first powder coating material onto said section of the surface of said workpiece comprises the steps of:

masking off said section from the remainder of the surface of said workpiece; and electrostatically spraying said first powder coating material onto said section of the surface of said workpiece.

14. The method as defined in claim 13, wherein the step of electrostatically bonding second powder coating material onto an area of said section of the surface of said workpiece comprises the steps of:

masking off said area from the remainder of the surface of said workpiece; and electrostatically spraying said second powder coating material onto said area of the surface of said workpiece.

15. The method as defined in claim 8, wherein the step of subjecting said section to electromagnetic radiation to at least partially cure said first powder coating material on said section comprises the step of passing said section by a source of infra-red radiation to partially cure said first powder coating material on said section.

16. The method as define din claim 8, wherein the step of subjecting said section to electromagnetic radiation to at least partially cure said first powder coating material on said section comprises the steps of:

passing said section by a source of infra-red radiation to partially cure said first powder coating material on said section; and passing said workpiece through a heated oven, thereby substantially completely curing said first powder coating material on said section of the surface of said workpiece.

17. A method of applying powder coating material to a recessed region of a surface of a workpiece, said method comprising the steps of:

electrostatically bonding powder coating material onto an area of the surface of said workpiece, said area including said recessed region and a non-recessed region;

frictionally engaging said non-recessed region of said area with a plurality of elastic bands to agitate the powder coating material thereon, thereby overcoming the electrostatic bond between the non-recessed region and the powder coating material thereon; and removing the agitated powder coating material on said non-recessed region without removing the powder coating material in said recessed region.

18. A method of coating a section of a surface of a workpiece comprising the steps of:

electrostatically bonding first powder coating material onto said section of the surface of said workpiece, said section including a recessed region and a non-recessed region;

at least partially curing said first powder coating material on said section;

electrostatically bonding second powder coating material onto an area of said section, said area including said recessed region and a portion of said non-recessed region;

frictionally engaging said portion of said non-recessed region to agitate the second powder coating material thereon, thereby overcoming the electrostatic bond between said portion of said non-recessed region and the second powder coating material thereon;

applying a vacuum to said area of said section to remove the agitated powder coating material on said portion of said non-recessed region; and curing said first and second powder coating materials on said area.

* * * * *

UNITED STATES PATENT AND TRADEMARK OFFICE

CERTIFICATE OF CORRECTION

PATENT NO. : 5,190,790

DATED : March 2, 1993

INVENTOR(S) : Blankemeyer

It is certified that error appears in the above-identified patent and that said Letters Patent is hereby corrected as shown below:

Col. 7, Line 14 "to agitate to" should be --to agitate the--.

Col. 9, Line 40 "define din" should be --defined in--.

Signed and Sealed this

Twenty-sixth Day of April, 1994

*Attest:*

Bruce Lehman

BRUCE LEHMAN

*Attesting Officer*

*Commissioner of Patents and Trademarks*